US008493172B2

(12) United States Patent
Pusateri et al.

(10) Patent No.: US 8,493,172 B2
(45) Date of Patent: Jul. 23, 2013

(54) VARIABLE SPEED TOGGLE TRIGGER

(75) Inventors: Daniel Pusateri, Grayslake, IL (US); Kenneth Happ, Burlington, WI (US); James Brehm, Racine, WI (US)

(73) Assignee: Snap-On Incorporated, Kenosha, WI (US)

( * ) Notice: Subject to any disclaimer, the term of this patent is extended or adjusted under 35 U.S.C. 154(b) by 34 days.

(21) Appl. No.: 13/250,284

(22) Filed: Sep. 30, 2011

(65) Prior Publication Data

US 2013/0082816 A1 Apr. 4, 2013

(51) Int. Cl.
*H01C 10/50* (2006.01)

(52) U.S. Cl.
USPC ..... 338/198; 338/200; 338/333

(58) Field of Classification Search
USPC ..... 338/198
See application file for complete search history.

(56) References Cited

U.S. PATENT DOCUMENTS

| | | | |
|---|---|---|---|
| 2,790,879 | A | 4/1957 | Ulinski |
| 3,260,827 | A | 7/1966 | Frenzel |
| 3,376,402 | A | 4/1968 | Bednarski |
| 3,467,801 | A | 9/1969 | Matthews |
| 3,536,973 | A | 10/1970 | Matthews et al. |
| 3,590,194 | A | 6/1971 | Frenzel et al. |
| 3,603,757 | A | 9/1971 | Sahrbacker |
| 3,632,936 | A | 1/1972 | Piber |
| 3,691,322 | A | 9/1972 | Matthews |
| 3,742,364 | A | 6/1973 | Matthews |
| 3,755,640 | A | 8/1973 | Kaman et al. |
| 4,095,072 | A | 6/1978 | Piber |
| 4,100,383 | A | 7/1978 | Piber |
| 4,459,522 | A | 7/1984 | Huber |
| 4,705,997 | A | 11/1987 | Juzswik |
| 4,864,083 | A | 9/1989 | Bittel |
| 4,894,492 | A | 1/1990 | Palumbo |
| 5,526,460 | A | 6/1996 | DeFrancesco et al. |
| 5,798,584 | A | 8/1998 | Schaeffeler et al. |
| 5,892,885 | A | 4/1999 | Smith et al. |
| 6,013,991 | A | 1/2000 | Philipp |
| 6,025,683 | A | 2/2000 | Philipp |
| 6,321,856 | B1 | 11/2001 | Alsruhe |
| 6,392,373 | B1 | 5/2002 | Glasgow et al. |
| 6,960,894 | B2 | 11/2005 | Carusillo et al. |
| 7,093,678 | B2 | 8/2006 | Risher et al. |
| 7,116,071 | B2 | 10/2006 | Glasgow et al. |
| 7,121,358 | B2 | 10/2006 | Gass et al. |
| 7,282,818 | B2 | 10/2007 | Kovarik |
| 7,359,628 | B2 | 4/2008 | Broghammer et al. |
| 7,400,106 | B2 | 7/2008 | DeCicco et al. |

(Continued)

OTHER PUBLICATIONS

PCT International Search Report, dated Nov. 28, 2012, 2 pages.

(Continued)

*Primary Examiner* — Kyung Lee
(74) *Attorney, Agent, or Firm* — Seyfarth Shaw LLP

(57) ABSTRACT

A variable speed toggle switch that allows a user to reverse a rotational direction of a motor and supply variable amounts of power to a motor, such as in a power tool, for example, a power drill. A trigger can include a gear segment that meshingly engages a gear on a potentiometer to electrically communicate the actuation direction and actuation amount of the trigger to a microprocessor. The microprocessor can then signal to an H-bridge, or to a series of transistors, the actuation direction and actuation amount of the trigger. A motor or other device can be powered by a power source in an amount corresponding to the actuation amount, and in a direction corresponding to the actuation direction of the trigger.

23 Claims, 4 Drawing Sheets

U.S. PATENT DOCUMENTS

| | | | |
|---|---|---|---|
| 7,420,341 | B2 | 9/2008 | Glasgow et al. |
| 7,476,821 | B1 | 1/2009 | Knuppel |
| 7,540,334 | B2 | 6/2009 | Gass et al. |
| 7,638,958 | B2 | 12/2009 | Philipp et al. |
| 7,708,085 | B2 | 5/2010 | DeCicco et al. |
| 7,861,796 | B2 | 1/2011 | DeCicco et al. |
| 7,926,585 | B2 | 4/2011 | Pozgay et al. |
| 2004/0113033 | A1 | 6/2004 | Johnson |
| 2007/0144310 | A1 | 6/2007 | Pozgay et al. |
| 2009/0071671 | A1 | 3/2009 | Zhong et al. |
| 2009/0148139 | A1 | 6/2009 | Decicco et al. |
| 2010/0061181 | A1 | 3/2010 | Malackowski et al. |

OTHER PUBLICATIONS

PCT Written Opinion of the International Searching Authority, dated Nov. 28, 2012, 9 pages.

VARIABLE SPEED TOGGLE TRIGGER

FIELD OF THE INVENTION

The present application relates generally to a trigger for a power tool. More particularly, the present application relates to a variable speed toggle trigger that allows a user to reverse the rotational output of a motor and supply variable amounts of power to the motor.

BACKGROUND OF THE INVENTION

Many conventional power tools include triggers or switches that facilitate the transfer of power from a power source to motor of the tool. For example, power drills have variable speed triggers that transfer a small amount of power to the drill bit when the trigger is depressed only slightly, but transfer a greater amount of power when fully depressed, thus causing the motor output to increase. These conventional tools may further include a reversing lever or switch to allow the user to reverse the rotational direction of the power tool to, for example, remove a workpiece from a working material. A power source, such as a battery, is coupled to the trigger and the reversing lever to provide appropriate power to the motor, which causes a motor to rotate in a desired direction and speed.

In the conventional tool, the trigger is a variable speed trigger where the amount of power transferred from the power source to the motor depends on how far the trigger is depressed. However, to reverse the direction of the output of the motor, the user must release the trigger and actuate the separate reversing lever located on the tool.

More recent developments in power tools have provided a toggle switch and trigger combination. The combination switch is a simple double-pole-double-throw switch configurable in two positions—forward and reverse. The combination switch supplies power to the motor at only one rotational speed, but can do so in either rotational direction without requiring a separate reversing lever.

Other recent developments have combined a toggle switch with two variable speed triggers so a user can actuate the trigger in a first direction to cause the output of the motor to rotate in a first direction, and can actuate the trigger in a second direction to cause the output of the motor to rotate in a second direction. This design requires two separate triggers that are mechanically coupled together by a rotating toggle switch and are somewhat expensive to manufacture due to the requirement of two switches.

SUMMARY OF THE INVENTION

The present application discloses a variable speed toggle switch that allows a user to reverse a rotational direction of a motor and supply variable amounts of power to a motor, such as in a power tool, for example, a power drill. A trigger can include a gear segment that meshingly engages a gear on a potentiometer to electrically communicate the actuation direction and actuation amount of the trigger to a microprocessor. The microprocessor can then signal to an H-bridge, or to a series of transistors, the actuation direction and actuation amount of the trigger. A motor or other device can be powered by a power source in an amount corresponding to the actuation amount, and in a direction corresponding to the actuation direction of the trigger.

In particular, the present application discloses a toggle switch including a trigger pivotably rotatable from a neutral position to first and second positions; a direction and amount measurement device operably coupled to the trigger and adapted to detect and electrically communicate a trigger signal indicating the actuation amount and the actuation direction of the trigger; and a microprocessor operably coupled to the direction and amount measurement device and adapted to receive the trigger signal; and facilitate a transmission of power to an external device based on the actuation amount and actuation direction of the trigger.

Also disclosed is a toggle switch including a trigger biased to a neutral position and rotationally movable toward a first position and a second position to indicate an actuation direction and actuation amount of the trigger; a potentiometer mechanically coupled to the trigger and adapted to output a trigger signal indicating the actuation direction and actuation amount of the trigger; and a microprocessor operably coupled to the potentiometer and adapted to receive the trigger signal and output a microprocessor signal to control an output direction and output speed of a motor.

A method of operating a toggle switch is also disclosed and includes providing a trigger pivotable to first and second positions; providing a direction and amount measurement device mechanically coupled to the trigger; receiving, in a microprocessor, a signal indicating an actuation amount and an actuation direction of the trigger from the direction and amount measurement device; and facilitating a transmission of power to a motor in a motor output direction and motor output speed based the signal.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages should be readily understood and appreciated.

DETAILED DESCRIPTION OF THE PREFERRED EMBODIMENTS

Figure 1:
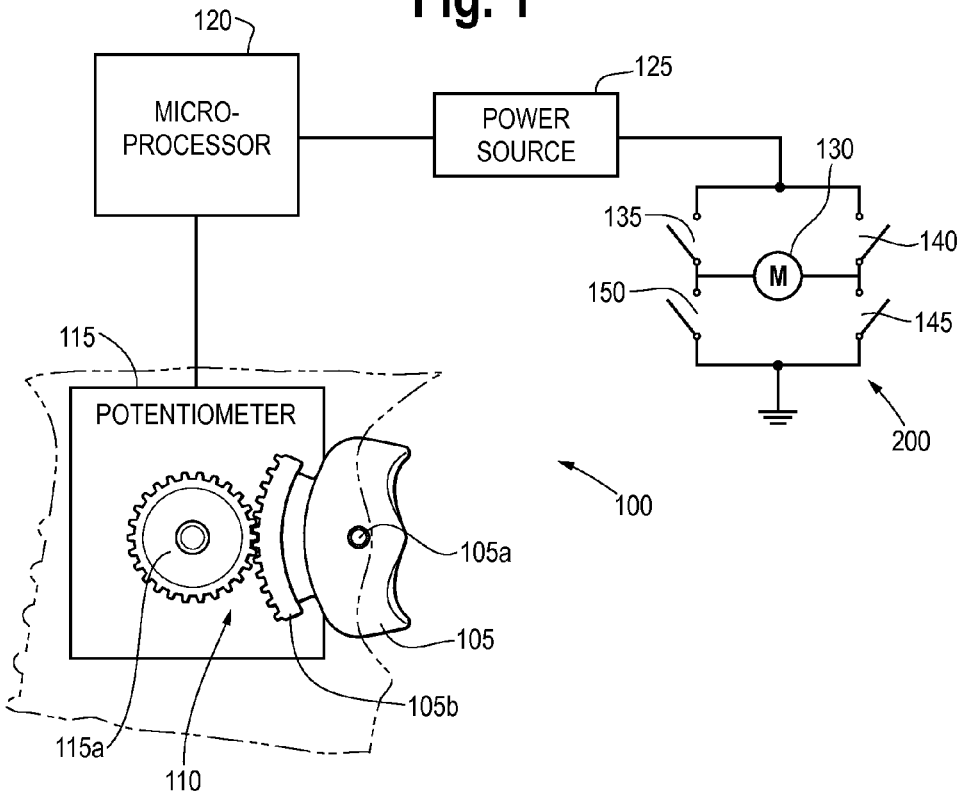
FIG. 1 is a diagrammatic view of an embodiment of the switch of the present application.

While the present invention is susceptible of embodiments in many different forms, there is shown in the drawings and will be herein described in detail a preferred embodiment of the invention with the understanding that the present disclosure is to be considered as an exemplification of the principles of the invention and is not intended to limit the broad aspect of the invention to embodiments illustrated.

The present application is directed to a switch adapted for use with a motor, such as disposed in a power tool, such as, for example, a power drill. In an embodiment, the variable speed toggle switch allows a user to choose a rotational direction of a motor and supply variable amounts of power to the motor. The trigger includes a gear segment that meshingly engages a gear on a potentiometer to electrically communicate the actuation direction and actuation amount of the trigger to a microprocessor. The microprocessor can then signal to an H-bridge, or to a series of transistors, the actuation direction and actuation amount of the trigger. The motor (or another device) can be powered by a power source in an amount corresponding to the actuation amount, and in a direction corresponding to the actuation direction of the trigger. The structure of the present application therefore allows a user to switch a rotational direction of the power tool and apply variable amounts of power to the motor with a single trigger mechanism and without the requirement of multiple electrical components and multiple user operations.

As shown in FIG. 1, the switch 100 includes a rotational trigger 105 having a gear assembly 110 that is adapted to communicate a rotational actuation amount and actuation direction of the trigger 105 to a direction and amount measurement device 115, such as a potentiometer. In an embodiment, the trigger 105 is adapted to rotationally pivot about pivot point 105*a*. In an embodiment, the direction and amount measurement device 115 is operably coupled to a gear 115*a*. The gear 115*a* is adapted to meshingly engage a trigger gear segment 105*b* in order to communicate the rotational movement of the trigger 105 to the direction and amount measurement device 115. In an embodiment, the direction and amount measurement device 115 is operably coupled to a microprocessor 120, which, in turn, is operably coupled to a power source 125 and a circuit such as an H-bridge 200. The H-bridge can have a motor 130 whose output is controlled by a first transistor 135, a second transistor 140, a third transistor 145 and a fourth transistor 150.

Based on the above structure, a user can actuate the trigger 105 from a biased neutral position, in which the actuation amount is substantially zero and substantially no power is transferred to the motor 130 and the output of the motor is substantially zero, to either a first position or a second position. In an embodiment, moving the trigger 105 toward the first position causes the motor 130 to output rotational movement in a first direction, and moving the trigger 105 toward the second position will cause the motor 130 to output rotational movement in a second direction. The amount of power distributed to the motor 130, and thus the rotational output of the motor, depends on the degree to which the trigger 105 is moved toward the first or second position. For example, if the trigger is moved slightly toward the first position, only a slight amount of power will be transferred to the motor 130, thus causing the output of the motor 130 to be low. In such an example, the rotational output of the motor 130 may be, for example, 400 rpm. Alternately, if the trigger 105 is closer to the first position, a greater amount of power will be transferred to the motor 130, thus causing the motor 130 output to increase. In such an example, the rotational output of the motor 130 may be, for example 2,000 rpm. In an embodiment, the trigger 105 is biased into the neutral position by a spring or other biasing structure so that the trigger 105 returns to the neutral position when the trigger 105 is released or, wherein substantially no power is supplied to the motor 130, thus causing the output of the motor 130 to stop.

The trigger 105 can be any shape or size and can be constructed of any material without departing from the spirit and scope of the present application. In an embodiment, the trigger 105 is ergonomically shaped to fit the contours of a finger or thumb, and can include contours to receive two or more fingers from the user and allow the user to pivotally rotate the trigger 105 about pivot point 105*a* either clockwise or counterclockwise to move the trigger 105 towards a first position or a second position. Alternately, the trigger 105 can be flat to allow the user to move a finger between the front and rear sides of the trigger 105 to change the rotational speed of the motor 130. The trigger 105 can be biased into the neutral position where substantially no output of the motor 130 is caused and the communicated actuation amount of the trigger is substantially zero.

The gear assembly 110 includes the trigger gear segment 105*b* and the potentiometer gear 115*a*, although any combination of gears or gear segments can be implemented without departing from the spirit and scope of the present application. The gear assembly is adapted to mechanically communicate the actuation amount and actuation direction of the trigger 105 to the microprocessor 120 via the direction and amount measurement device 115. In an embodiment, gear segment 105*b* is integral with the trigger 105.

A direction and amount measurement device 115, such as a potentiometer, is adapted to detect the rotational amount and direction of the trigger 105 as mechanical parameters from the gear assembly 110 and transmits an electrical signal to a microcontroller 120 to control the amount of power transmitted to motor 130 based on the rotational amount and direction of the trigger 105. The direction and amount measurement device 115 can be any form of potentiometer, for example, a rotary or trimpot potentiometer. Alternately, a strain gauge can be used as the direction and measurement device 115 and can translate the rotational amount and direction of the trigger 105 into an electrical signal to be communicated to the microcontroller 120. Alternately, a piezoelectric component or a series of piezoelectric components can be used as the direction and amount measurement device 115 to communicate the mechanical energy represented by the rotational amount and actuation direction of the trigger 105 to electrical signals that can be communicated to the microprocessor 120. Accordingly, it is to be understood that any type of device 115 that is adapted to detect the amount and direction of trigger 105 movement can be used without departing from the scope and spirit of the present application.

The microprocessor 120 can be any electrical component capable of receiving electrical signals and, based on stored software or firmware, perform various functions after receipt of the electrical signals. The microprocessor 120 controls the electrical operation of the switch 100 and communicates with transistors 135, 140, 145, 150, such as field effect transistors 135, 140, 145, 150 to control the output speed and direction of motor 130, as discussed below in more detail.

In an embodiment, the microprocessor 120 can execute software or firmware that manages various parameters of the power source 125 to ensure that the power source 125 safely and efficiently operates within the switch 100. For example, the microprocessor 120 can communicate with the power source 125 to receive signals indicating the temperature, charge, current flow, and/or voltage state of the power source 125. In an embodiment, the software or firmware can include data indicating various predetermined thresholds that establish an acceptable range for such parameters. For example, if the power source 125 is a Li-ion battery, an acceptable temperature range of the battery can be between −40° C. and 60° C. If the battery temperature reaches near a threshold limit, e.g., 60° C., the software/firmware executed by the microprocessor 120 can effectively disconnect the power source 125 and/or communicate an error signal to the user to notify the user that the power source 125 is overheating. Any other power source 125 parameter can be monitored by the software/firmware and the user can be notified of problematic parameter values in any other manner without departing from the spirit and scope of the present application.

The power source 125 can be any source of electrical or mechanical power that can drive the motor 130. In an embodiment, the power source 125 is a battery. However, the power source 150 can be any component that provides power, including a battery, fuel cell, engine, solar power system, wind power system, hydroelectric power system, a power cord for attachment to an electrical socket, or any other means of providing power.

The motor 130 can be any type of motor, including an electrical, internal combustion, electrochemical, or any other form of motor that can impart axial or rotational motion to an object. In an embodiment, the motor 130 is an electrical motor capable of outputting rotational power in either a clockwise or counterclockwise direction based on separate inputs that each communicates with the transistors 135, 140, 145, 150.

The transistors 135, 140, 145, 150 are operably coupled to the microprocessor 120 and are adapted to receive electrical signals from the microprocessor 120 based on the rotational amount and direction of the trigger 105. In an embodiment, the transistors 125, 130, 135, 140 are field effect transistors, and more preferably metal oxide semiconductor field effect transistors (MOSFET) that can selectively allow electrical current to pass therethrough when a particular electric field is applied. For example, in the MOSFET embodiment, the field effect transistors 135, 140, 145, 150 can be p-channel MOSFETS where a negative gate voltage allows current to pass through the individual transistor. However, the field effect transistors 135, 140, 145, 150 can be any type of MOSFET, including a n-channel MOSFET, or can be any other form of transistor, switching element, or any other structure that facilitates a switching operation, without departing from the spirit and scope of the present application.

As shown in the exemplary embodiment of FIGS. 1-43, the field effect transistors 135, 140, 145, 150 can include a first MOSFET 135, a second MOSFET 140, a third MOSFET 145, and a fourth MOSFET 150 each disposed within an H-bridge 200. In this example, MOSFETs 135, 140, 145, 150 can communicate with the microprocessor 120 and the motor 130 to allow the selective transmission of power to the motor 130 based on the rotational direction of the trigger 105.

Figure 2:
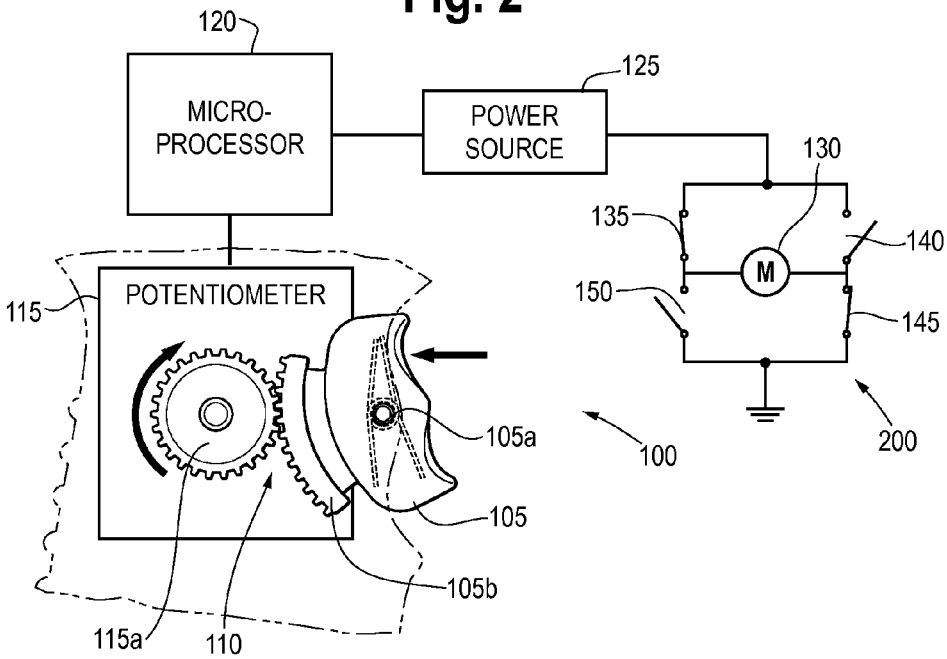
FIG. 2 is a diagrammatic view of an embodiment of the switch of the present application when engaged in the forward rotating position.
Figure 3:
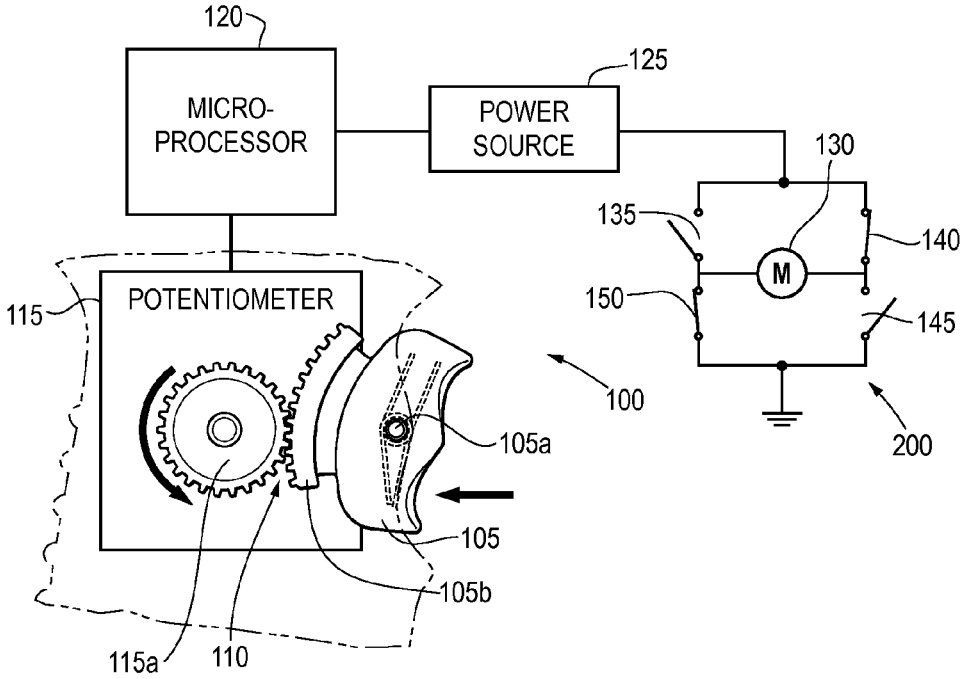
FIG. 3 is a diagrammatic view of an embodiment of the switch of the present application when engaged in the reverse rotating position.

As shown in FIG. 1, the switch 100 is biased in the neutral position or middle position by a biasing structure, such as one or more torsion springs, such that substantially no power is transferred to the motor and the actuation amount and direction of the trigger 105 is substantially zero. If the user actuates the trigger 105 toward the first position, as shown in FIG. 2, the microprocessor 120 can communicate with the H-bridge and apply an appropriate voltage to the first MOSFET 135 and the third MOSFET 145 to close the first and third MOSFETs 135, 140 and controllably facilitate the flow of power to the motor 130 such that the motor output rotates in a first direction. However, if the user actuates the trigger 105 toward the second position, as shown in FIG. 3, the microprocessor 120 can apply an appropriate voltage amount to the second and fourth MOSFETs 140, 150 to close the second and fourth MOSFETs 140, 150 and controllably facilitate the flow of power to the motor 130 such that the motor output rotates in a second direction. The voltage amount applied to the selected MOSFETs will depend on the actuation amount of the trigger 105. As discussed above, a greater actuation amount will result in a greater amount of voltage applied to the motor 130.

Figure 4:
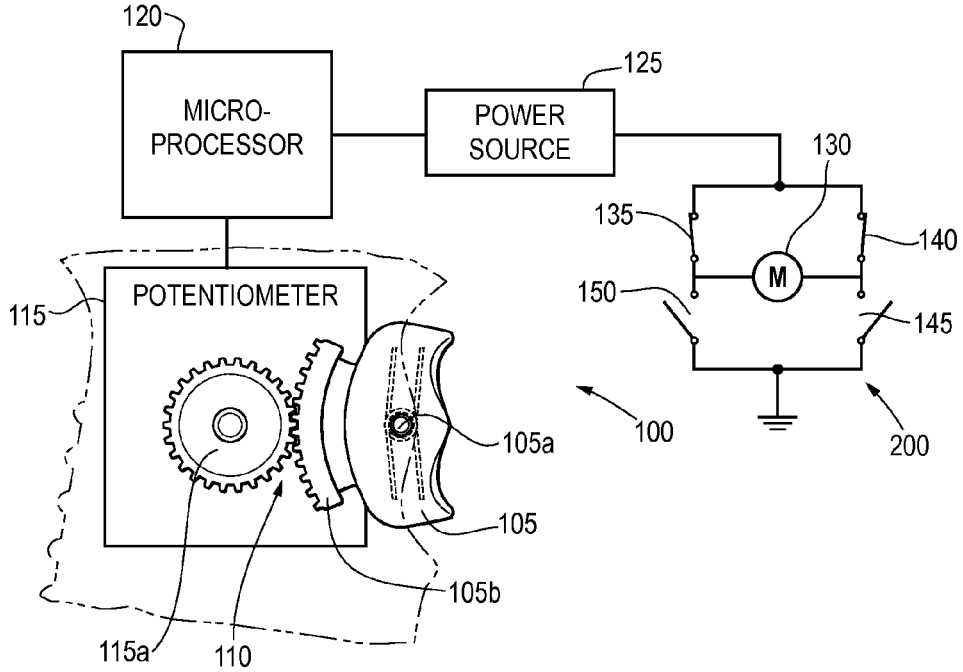
FIG. 4 is a diagrammatic view of an embodiment of the switch of the present application when engaged in the braking position.

The H-bridge 200 can implement a braking operation when the trigger 105 is released from the first or second position toward the neutral position. For example, as shown in FIG. 4, the direction and amount measurement device 115 can communicate to the microprocessor 120 that the actuation amount of the trigger 105 has decreased and that the motor 130 speed should decrease in accordance with the braking operation. The microprocessor 120 can then communicate with the H-bridge 200 to perform the braking operation, as shown in FIG. 4. To perform the braking operation, the microprocessor 120 causes the first transistor 135 and the second transistor 140 to close, effectively shorting the motor 130. However, any other braking mechanism or electronic process can be used without departing from the spirit and scope of the present application.

In an embodiment, the first transistor 135 and the second transistor 140 can be p-channel MOSFETs, and the third transistor 145 and the fourth transistor 150 can be n-channel MOSFETs. When actuating the motor 130 in the first direction, the first transistor 135 can be completely closed while the third transistor 145 can be modulated to facilitate the variable supply of power to the motor 130. The inventors of the present application discovered that the above configuration is advantageous in that only one of the MOSFETs is modulated, resulting in a simpler design, and modulating the n-channel MOSFET results in less resistance, and in turn, less power consumption and heat generation.

Figure 5:
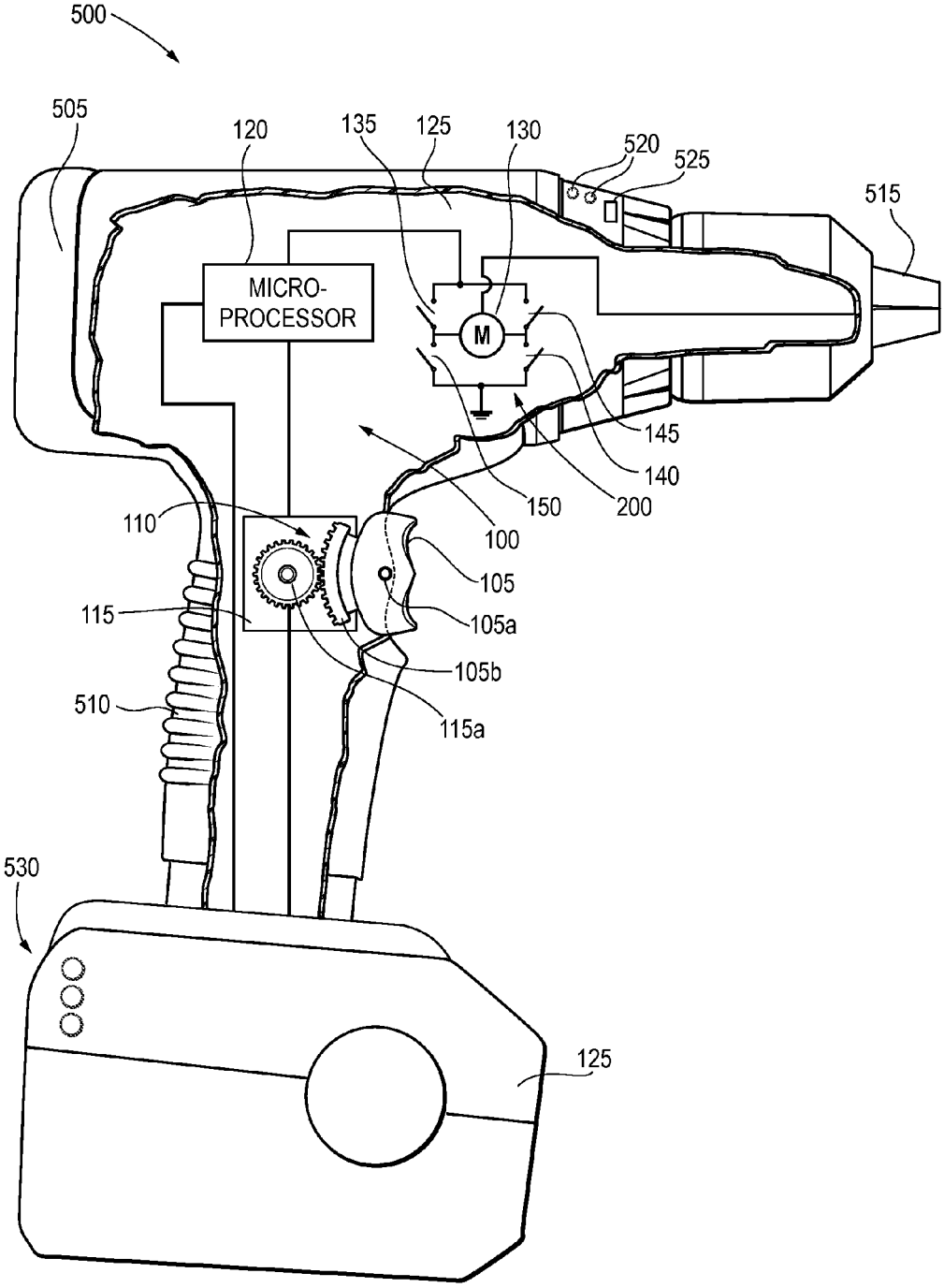
FIG. 5 is an internal view of a power tool, such as a power drill, incorporating a switch according to the present application.

FIG. 5 illustrates a tool 500, such as a power drill, that implements a switch 100 according to the present application. As shown, the tool 500 includes a body 505 with the trigger 105 provided opposite a grip 510, and the power source 125 coupled to the body 505 at a bottom portion of the body 505. A chuck 515 is provided at a working end of the tool 500 for gripping tool bits, e.g. a drill bit, during operation in a well known manner. A light emitting diode (LED) gauge 530 may be disposed adjacent to the power source 150 to indicate an amount of power remaining in the power supply 150 that can be transmitted. A diagnostic check button 520 and LED headlights 525 may be disposed on a top of the tool 500 and provide various functions, discussed below in more detail.

The grip 510 is disposed opposite the trigger 105 on the body 505 of the tool 500. The grip 510 can be any structure or material that allows the user to grasp the body 505 of the tool 500 in a well-known manner. In an embodiment, the grip 510 can be ergonomically shaped to fit the user's hand and allow a convenient and comfortable position for the user to engage the trigger 105 with a finger or thumb. As shown, the grip 510 can be a textured surface of the body 505, or can be a separate material and structure that is coupled to the body 505 by, e.g., adhesive. For example, the grip 510 can be made of rubber, metal, foam, leather, or any other material that helps the user grip the tool 500.

The chuck 515 is located at the working end of the tool 500 and serves to hold the tool bit and provide direct rotational movement to the tool bit in a well known manner. The chuck 515 can be any shape or material, and, in an embodiment, is frustraconical with several radial segments that converge to frictionally engage a tool bit. The tool bit itself can be any instrument that can transmit torque or impact on a workpiece. For example, the tool bit can be a drill bit, a Phillips head or flat head screwdriver, an endmill, socket, impact driver, or any other object that can be inserted into the chuck 320 and assist the user in machining or fastening a working material.

The LED gauge 530 may include a plurality of lights that indicate the amount of power remaining in the power source 125. For example, if the power source 125 is a Li-ion battery, the LED gauge 530 can communicate with the battery to provide a visual indicator of the state of charge of the battery. As shown, the LED gauge 530 can include a plurality of LEDs, where illumination of all LEDs may indicate a fully-charged state of the battery or other power source 125, where two illuminated LEDs may indicate a moderately charged power source 125, etc. The LED gauge 530 can also include multiple colors to indicate the state of charge of the power source 125, e.g., where green indicates a well-charged power source 125, but red indicates a poorly-charged power source 125. Of course, any number of LED lights and any color scheme can be implemented for the LED gauge 530 without departing from the spirit and scope of the present application.

The LED headlights 520 and diagnostic check button 525 can be operably coupled to assist the user in diagnosing mechanical or electrical issues with the tool 500. For example, the user can actuate the diagnostic check button 525 and the software/firmware associated with the tool 500 can communicate with the internal feedback circuits via the microprocessor 120 to determine whether a malfunction exists and, if so, where the malfunction is occurring. The microprocessor 120 can then determine which error code to communicate through the LED headlights 520. For example, if the microprocessor 120 determines that the problem is a disconnected or malfunctioning wire between the trigger 105 and the power source 125, the microprocessor 120 can send a signal to the LED headlights 520 to blink three times, indicating the problem to the user and allowing the user to take the necessary procedures to fix the problem. When not used to diagnose a malfunction, the LED headlights 520 can provide additional light directed at a workpiece that will be acted upon by the tool 500.

Figure 6:
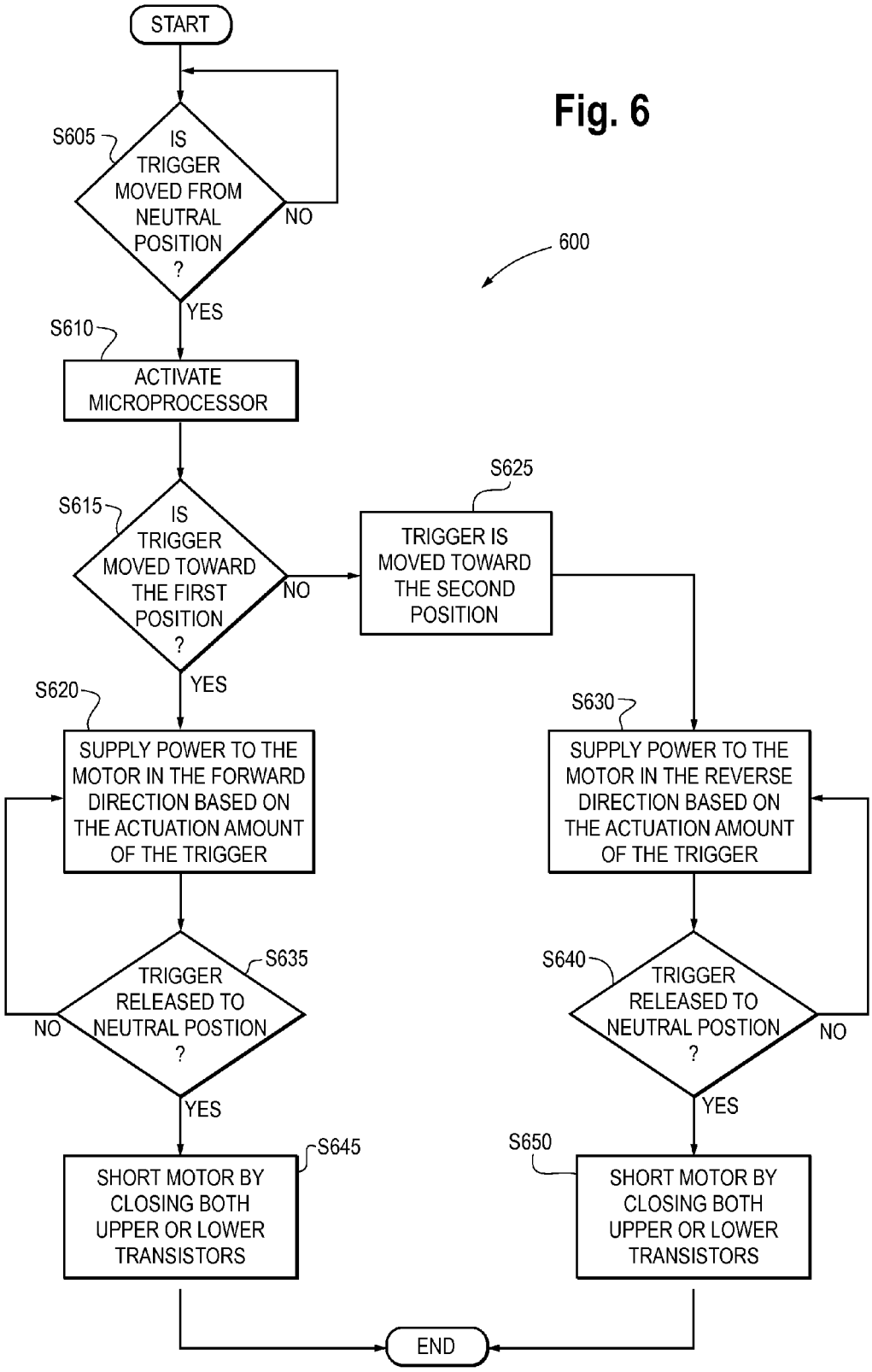
FIG. 6 is a flow chart depicting a method of using a power tool incorporating a switch of the present application.

An exemplary method 600 of using the switch 100 and/or tool 500 according to the present application will be discussed below with reference to FIG. 6. As shown, the method 600 begins and proceeds to S605, where it is determined whether the trigger 105 has moved from the neutral position, in which the actuation amount of the trigger 105 is substantially zero. If it is determined that the trigger 105 has been moved either toward the first or second positions, the process proceeds to S610, where the microprocessor 120 is activated. Prior to this step, the microprocessor 120 is deactivated to avoid overheating of the processor 120 and to save power consumption.

Once the microprocessor 120 is activated, the process proceeds to S615 where it is determined whether the trigger 105 has been moved toward the first position. If the trigger 105 has been moved toward the first position, the process has been instructed by the user that the output of the motor 130 should be rotated in a first direction and at a desired speed, based on the amount of actuation of the trigger 105 toward the first position. Thus, if the trigger 105 has been moved toward the first position, the process proceeds to step S620 where the microprocessor 120 facilitates the transmission of power from the power source 125 to the motor 130 in a manner that causes the output of the motor 130 to rotate in a first direction at a desired speed. Alternately, if the trigger 105 is moved toward the second position, the microprocessor 120 determines that the trigger 105 has moved toward the second position in step S625 and proceeds to step S630, where voltage is supplied to the motor in a second direction based on the rotation amount of the trigger 105.

To select the appropriate motor output direction and actuation amount, the trigger 105 rotates the trigger gear segment 105*b* and, in turn, rotates the gear 115*a* of the potentiometer 115 to translate the mechanical actuation of the trigger 105 into an electrical signal that can be received by the microprocessor 120. The switch 100 of the present application can thus control the motor output direction and speed in one simple step rather than requiring the user to separately select the motor output direction with a reversing lever.

Once the trigger 105 is actuated toward either the first or second directions, the process determines the moment when the trigger 105 is fully or partially released and biased toward the neutral position in step S635, S640. Once the trigger 105 is moved toward the neutral position, the method proceeds to either S645 or S650 depending on whether the motor 130 is rotating in the first or second rotational direction. In steps S645 and S650, voltage may be supplied to either the first 135 and second 140 transistors, as shown in FIG. 4, to short the motor 130 and brake the motor 130 output. Following the braking operations in S645 and S650, the process ends.

The exemplary embodiments of this application have implemented the switch 100 in power tools such as a drill, or have implemented the switch 100 with a motor 130. However, the invention is not limited to implementation in drills or motors. Any other device can be implemented with the switch 100 without departing from the spirit and scope of the present application. For example, the switch 100 can be installed in an electric or air-powered drive tool, a power saw, a vacuum cleaner, or any other device that can implement a variable speed electrical toggle switch.

The manner set forth in the foregoing description and accompanying drawings and examples, is offered by way of illustration only and not as a limitation. More particular embodiments have been shown and described, and it will be apparent to those skilled in the art that changes and modifications may be made without departing from the broader aspects of Applicant's contribution. The actual scope of the protection sought is intended to be defined in the following claims when viewed in their proper prospective based on the prior art.

What is claimed is:

1. A toggle switch comprising:

a trigger pivotable from a neutral position to first and second positions;

a pivot measurement device including a potentiometer mechanically coupled to the trigger, wherein the pivot measurement device is adapted to detect and electrically communicate a trigger signal indicating an amount of pivotal movement of the trigger and pivotal direction of the trigger based on a trigger position relative to the first and second positions; and a microprocessor operably coupled to the pivot measurement device and adapted to:

receive the trigger signal; and control transmission of an amount of power to an external device based on the amount of pivotal movement of the trigger and the pivotal direction of the trigger.

2. The toggle switch of claim 1, wherein the external device includes a motor adapted to receive the amount of power from a power supply.

3. The toggle switch of claim 1, wherein the amount of power is determined by the amount of pivotal movement of the trigger relative to either of the first and second positions.

4. The toggle switch of claim 1, further comprising an H-bridge having first, second, third and fourth transistors selectively coupled to the external device and the microprocessor.

5. The toggle switch of claim 4, wherein the first and second transistors are p-channel metal oxide semiconductor field effect transistors (MOSFET), and the third and fourth transistors are n-channel MOSFET, and the microprocessor is further adapted to selectively close one of the first and second transistors and selectively modulate one of the third and fourth transistors to vary the amount of power.

6. The toggle switch of claim 1, wherein the trigger includes a first gear and the pivot measurement device includes a second gear meshingly engaged with the first gear, wherein the second gear is adapted to communicate the amount of pivotal movement and the pivotal direction to the pivot measurement device.

7. The toggle switch of clam 1, wherein the microprocessor includes a computer readable medium adapted to store instructions that cause the microprocessor to:

monitor a parameter of a power source operably coupled to the microprocessor;

determine whether the parameter is within a predetermined acceptable range; and alert a user if the parameter is outside of the predetermined acceptable range.

8. The toggle switch of claim 7, wherein the parameter is selected from the group consisting of a temperature, state of charge, current flow, and voltage, of the power source.

9. The toggle switch of claim 1, wherein the trigger is biased to the neutral position with a biasing structure, wherein the amount of pivotal movement is considered substantially zero.

10. The toggle switch of claim 9, wherein the biasing structure includes a spring.

11. A toggle switch comprising:

a trigger having a trigger position biased to a neutral position and pivotably movable between first and second positions, wherein the neutral position is disposed intermediate the first and second positions;

a potentiometer mechanically coupled to the trigger and adapted to output a trigger signal indicating a pivotal direction and amount of pivotal movement of the trigger relative to the first and second positions; and a microprocessor operably coupled to the potentiometer and adapted to receive the trigger signal and output a microprocessor signal adapted to control an output direction and output speed of a motor.

12. The toggle switch of claim 11, wherein the output speed is based on the pivotal amount of movement.

13. The toggle switch of claim 11, further comprising first, second, third, and fourth transistors wherein first and second transistors are p-channel metal oxide semiconductor field effect transistors (MOSFET), and the third and fourth transistors are n-channel MOSFET, and the microprocessor is further adapted to selectively close one of the first and second transistors and selectively modulate one of the third and fourth transistors to vary an amount of power delivered to the motor.

14. The toggle switch of claim 11, further comprising an H-bridge having first, second, third and fourth transistors selectively coupled to the motor and to the microprocessor.

15. The toggle switch of claim 14, wherein the first and second transistors are p-channel metal oxide semiconductor field effect transistors (MOSFET), and the third and fourth transistors are n-channel MOSFET, and the microprocessor is further adapted to selectively close one of the first and second transistors and selectively modulate one of the third and fourth transistors to vary an amount of power delivered to the motor.

16. The toggle switch of clam 11, wherein the microprocessor includes a computer readable medium adapted to store instructions that cause the microprocessor to:

monitor a parameter of a power source operably coupled to the microprocessor;

determine whether the parameter is within a predetermined acceptable range; and alert a user of the toggle switch if the parameter is outside of the predetermined acceptable range.

17. The toggle switch of claim 11, wherein the trigger includes a first gear and the potentiometer includes a second gear meshingly engaged with the first gear, wherein the second gear is adapted to communicate the pivotal direction and pivotal amount to the potentiometer.

18. A method of varying an amount of power delivered to a motor comprising:

pivoting a trigger to a trigger position between first and second positions, thereby defining a pivot amount and pivot direction;

causing a direction and amount measurement device including a potentiometer mechanically coupled to the trigger, to generate a signal based on the amount of pivotal movement and pivot direction relative to the first and second positions;

causing the delivery of the signal to a microprocessor; and causing the microprocessor to vary the amount of power delivered to the motor and a direction of the motor based on the signal.

19. The method of claim 18 further comprising causing an output of the motor to rotate based on the pivot position.

20. The method of claim 18, further comprising:

determining whether the trigger is moved toward a neutral position disposed intermediate the first and second positions, wherein when disposed in the neutral position the pivot amount is considered substantially zero; and selecting a set of MOSFETs within an H-bridge to short the motor.

21. The method of claim 18, further comprising activating the microprocessor based on an initial pivot amount of the trigger.

22. The method of claim 18, further comprising:

causing selective closing of one of either first and second p-channel MOSFETs operably coupled to the motor; and causing selective modulation of one of either third and fourth n-channel MOSFETs operably coupled to the motor.

23. The toggle switch of claim 1 wherein the neutral position is disposed intermediate the first and second positions.

* * * * *